US007240804B2

(12) United States Patent
King et al.

(10) Patent No.: US 7,240,804 B2
(45) Date of Patent: Jul. 10, 2007

(54) FULL CONTACT FLOATING ROOF

(76) Inventors: Richard P. King, 23832 Tomball Pkwy., Tomball, TX (US) 77375; John Oleyar, 23832 Tomball Pkwy., Tomball, TX (US) 77375; David Bretherton, 23832 Tomball Pkwy., Tomball, TX (US) 77375

( * ) Notice: Subject to any disclaimer, the term of this patent is extended or adjusted under 35 U.S.C. 154(b) by 0 days.

(21) Appl. No.: 11/286,791

(22) Filed: Nov. 23, 2005

(65) Prior Publication Data

US 2006/0076351 A1 Apr. 13, 2006

Related U.S. Application Data

(63) Continuation of application No. 10/397,719, filed on Mar. 26, 2003, now abandoned.

(51) Int. Cl.
*B65D 88/36* (2006.01)

(52) U.S. Cl. ..... 220/218; 52/309.4

(58) Field of Classification Search ..... 220/216–226; 52/309.4, 309.5–309.16
See application file for complete search history.

(56) References Cited

U.S. PATENT DOCUMENTS

| | | | | |
|---|---|---|---|---|
| 1,783,118 | A * | 11/1930 | Griffin | 220/218 |
| 3,374,918 | A * | 3/1968 | Creith | 220/216 |
| 3,592,009 | A * | 7/1971 | Glijnis et al. | 405/53 |
| 3,724,704 | A * | 4/1973 | Edwards et al. | 220/226 |
| 4,024,310 | A * | 5/1977 | Wooler et al. | 442/52 |
| 4,036,394 | A * | 7/1977 | Bodley et al. | 220/222 |
| 4,120,123 | A * | 10/1978 | Knudson | 52/86 |
| 4,202,460 | A * | 5/1980 | Imbeault | 220/218 |
| 4,213,280 | A * | 7/1980 | Sandborn | 52/309.9 |
| 4,602,587 | A * | 7/1986 | Lyons | 114/264 |
| 5,704,509 | A * | 1/1998 | Rosenkrantz | 220/216 |
| 6,922,956 | B2 * | 8/2005 | Johnson et al. | 52/192 |
| 2003/0042256 | A1 * | 3/2003 | Johnson et al. | 220/216 |

* cited by examiner

*Primary Examiner*—Lien M. Ngo

(57) ABSTRACT

A device and method of making a full contact floating roof for use in covering fluid bodies, such as storage tanks containing hydrocarbon fluids, allowing ease of construction, high integrity, and low maintenance cost.

1 Claim, 5 Drawing Sheets

FULL CONTACT FLOATING ROOF

CONTINUATION APPLICATION

This application is a continuation of U.S. patent application Ser. No. 10/397719, filed Mar. 26, 2003 now abandoned.

TECHNICAL FIELD

The invention concerns a device for covering or sealing a liquid containment storage tank with a full contact floating roof, and method for making it

BACKGROUND OF THE INVENTION

Liquid containment storage tanks are frequently used to store hydrocarbon liquids. When the stored liquid is volatile or presents a risk of pollution through evaporation, the storage tank is often equipped with a floating roof, which floats on top of the stored liquid and moves up and down with the liquid level. Floating roofs greatly reduce liquid evaporation, preventing loss of the stored liquid and reducing pollution due to hydrocarbon evaporation into the atmosphere.

Such floating roofs are often provided with support legs which are usually spaced about twenty feet apart and provide support to the roof when the roof is not floating on stored liquid, such as when the tank is emptied or taken out of service for maintenance. These roofs are usually floated by pontoons which are secured to the roof support structure. However, such pontoon-floated roofs leave a vapor space above the liquid surface in the tank. Thus, evaporation will occur in the tank until the vapor space is saturated, at which point equilibrium between the vapor space and the liquid is reached.

However, there will be losses of the liquid stored in the tank, as vapor leaks through seams in the roof or around seals. Engineering of floating roofs attempts to eliminate such leakage losses, but the existence of a relatively volatile vapor space immediately under the roof makes absolute elimination of such losses impossible.

Elimination of the vapor space is possible by using a full contact floating roof. Existing full contact roofs include aluminum and steel roofs. Aluminum full contact roofs are usually comprised of panels bolted to an aluminum framework. Such panels may comprise expanded aluminum honeycomb, or a foam core sandwiched between two layers of aluminum sheet. Most full contact steel roofs are constructed from steel plate welded together and surrounded by steel pontoons. Other, "pan type" steel roofs are simple flat plate welded together with a vertical rim along the edge.

However, these types of full contact roofs have engineering and practicality limitations. Current full contact roof designs are only marginally capable of sustaining the loads imposed on the structures. They are also easily upset and sunk if there is a large operations anomaly in the underlying tank. Because these roofs have to be constructed in the field, there are high labor and heavy-equipment machinery costs associated with assembling and moving materials around at the construction site. Further, steel roofs require periodic repainting and are very susceptible to corrosion, creating high maintenance costs and potentially limiting the useful life of the roof.

A further limitation of the aluminum honeycomb or foam core sandwiched-panel type roofs is the inability to test the individual honeycomb cells for the presence of a foreign or combustible vapor. Such vapor may be present if there is a leak in the outer sheeting cover. Moreover, the aluminum honeycomb or foam core sandwiched panels are normally joined to the outer aluminum sheeting cover with glue or adhesive that frequently becomes brittle and inflexible after being applied. Cyclic operation of the floating roof, or certain external loading conditions on the outer sheeting cover, such as walking on the roof, often cause theis glue or adhesive to crack, forming vapor or liquid paths between the individual compartments. Thus, the leak-tight integrity of the individual compartments may be compromised.

Accordingly, it is an object of the invention to provide a full contact floating roof which is full contact, yet is made of relatively lightweight, durable, and stable materials which are easy to assemble.

It is a further object of the invention to provide a full contact floating roof which is difficult to upset and sink.

It is another object of the invention to provide a full contact floating roof which provides additional options for fire protection over existing roofs.

BRIEF DISCLOSURE OF THE INVENTION

The invention comprises a full contact floating roof, constructed from a plurality of buoyant cells. In the preferred embodiment, these buoyant cells are formed by sections of extruded fiber reinforced plastic ("FRP"). By creating a fluid- and vapor-impermeable join between multiple buoyant cells, groups of such cells are joined together side by side to form the roof. Although the shell, or body, of the buoyant cells can be formed in any reasonable geometric shape which will still allow the proper joins between cells, in the preferred embodiment the shells are square-angle parallelepipeds, for example, box-like rectangular cells. Each cell must provide sufficient displacement so that the weight of the cell, plus any additional load the cell is expected to support, will float on top of the fluid which will be beneath the full contact floating roof.

In the preferred embodiment, each cell is extruded with a gripping slot on each side (as used herein, the cell's "bottom" is considered to be that side of the cell in contact with the contained fluid, the cell's "top" is that portion of the cell exposed to the open air or other atmosphere above the contained fluid, and the cell's "sides" are the sections of the cells which can be joined to other cells), into which can be inserted a formed, rigid or semi-rigid strip which, when inserted into the gripping slots of two of the cells, will maintain the sides of those cells in close proximity to each other and without allowing substantial relative movement of the cells. Additionally, it is preferred that an adhesive sealant, glue, or epoxy, such as Pliogrip (Ashland Chemical) is applied to the side surfaces of each two cells being joined, so that the final join between the cells will both be strong and provide a sufficient seal to prevent the escape of contained fluid or vapor from the bottom of the cells.

Also in the preferred embodiment, the buoyant cells are approximately two feet wide, and comprise interior risers which serve both to support the top surface of the cell against applied loads and to form internal barriers, breaking the interior of the cell into a series of individual sub-cells. Because it is preferred that the buoyant cells are extruded, the sub-cells created by the risers will run the full length of the cell, and will be sealed at either end with blocks of material such as Valox during assembly of the roof. Thus, each sub-cell can independently provide a sealed airspace. These block seals are additionally preferably glued in place with Pliogrip to insure a complete seal.

This method of construction also allows the use of the same basic buoyant cells to form any particular shape of roof. For example, a circular roof can be formed by cutting the necessary arc along the edge of a series of joined buoyant cells, then sealing the exposed ends of the sub-cells. These cuts may be curved or may be miter cut in chords. The curved or chord cuts may be sealed in the same fashion as would a flat cut, thus allowing square, rectangular, circular, oval, elliptical, or other shapes of floating roofs to be formed using the same materials and same construction methods.

Constructed in this manner, each sub-cell provides an independent flotation device. Further, the individual sub-cells can be flooded with gas, such as an inert gas, to improve fire protection when the floating roof is used to contain volatile hydrocarbons. This process may be accomplished economically by inserting a valve or a selectively pluggable coupling through the top of each sub-cell. Moreover, a self-activating sealant or intumescent material such as Contega or Flameseal, for example, can be used to coat the interior of the sub-cells prior to sealing them, so that in the event of a fire above the roof, the individual sub-cells will close off and aid in preventing the fire from reaching the contained fluid. Alternatively, inserts coated with such materials can be inserted in the sub-cells. Similarly, in the event of a puncture of the roof and subsequent fire, the intumescent material can act to expand and seal the hole, thereby suppressing the fire if it has reached the contained fluid. a puncture of the roof and subsequent fire, the intermescent material can act to expand and seal the hole, thereby suppressing the fire if it has reached the contained fluid.

Thus, this floating roof provides a variety of advantages over other such roofs. Because the extruded materials are relatively lightweight and can be shipped as individual cells, or pre-assembled into sectional panels to be assembled on-site into a single roof, the cost and complexity of construction assembly on-site is greatly reduced. Further, the manner of construction, involving simple mechanical tools and adhesives, greatly reduces the need for skilled labor on site, as is required to weld steel sections together or to assemble complex, bolted, aluminum frameworks. Moreover, the extruded materials provide further advantages, because they are extremely corrosion resistant and therefore provide cost savings for long-term maintenance of the roof once it is installed.

The modular nature of the buoyant cells further allows each section to be tested for internal fluid or vapor leaks by providing signal communication between a fluid or vapor detection device internal to the cell and a monitor outside the cell. Detectors can be placed within each sub-cell, and connected together by drilling or cutting through the riser wall to allow a signal coupler, such as a wire or cable, to be passed between sub-cells. The integrity of the sub-cells can be restored by gluing a seal in place around the signal coupler where it passes through the riser. Alternatively, test ports can be inserted in any sub-cell through the external skin of a buoyant cell, sealed in place, and connected to an external detection device to test the sub-cell for fluid or vapor leaks.

Because holes from the top to the bottom of an extruded panel can be sealed off from the remainder of the sub-cell or sub-cells though which the hole passes by means of seals and adhesives, it is also relatively easy to provide drains or manholes through a buoyant cell, allowing rainwater or other fluid to be drained away and allowing for inspection of the region under the floating roof.

DESCRIPTION OF THE PREFERRED EMBODIMENT

Figure 1:
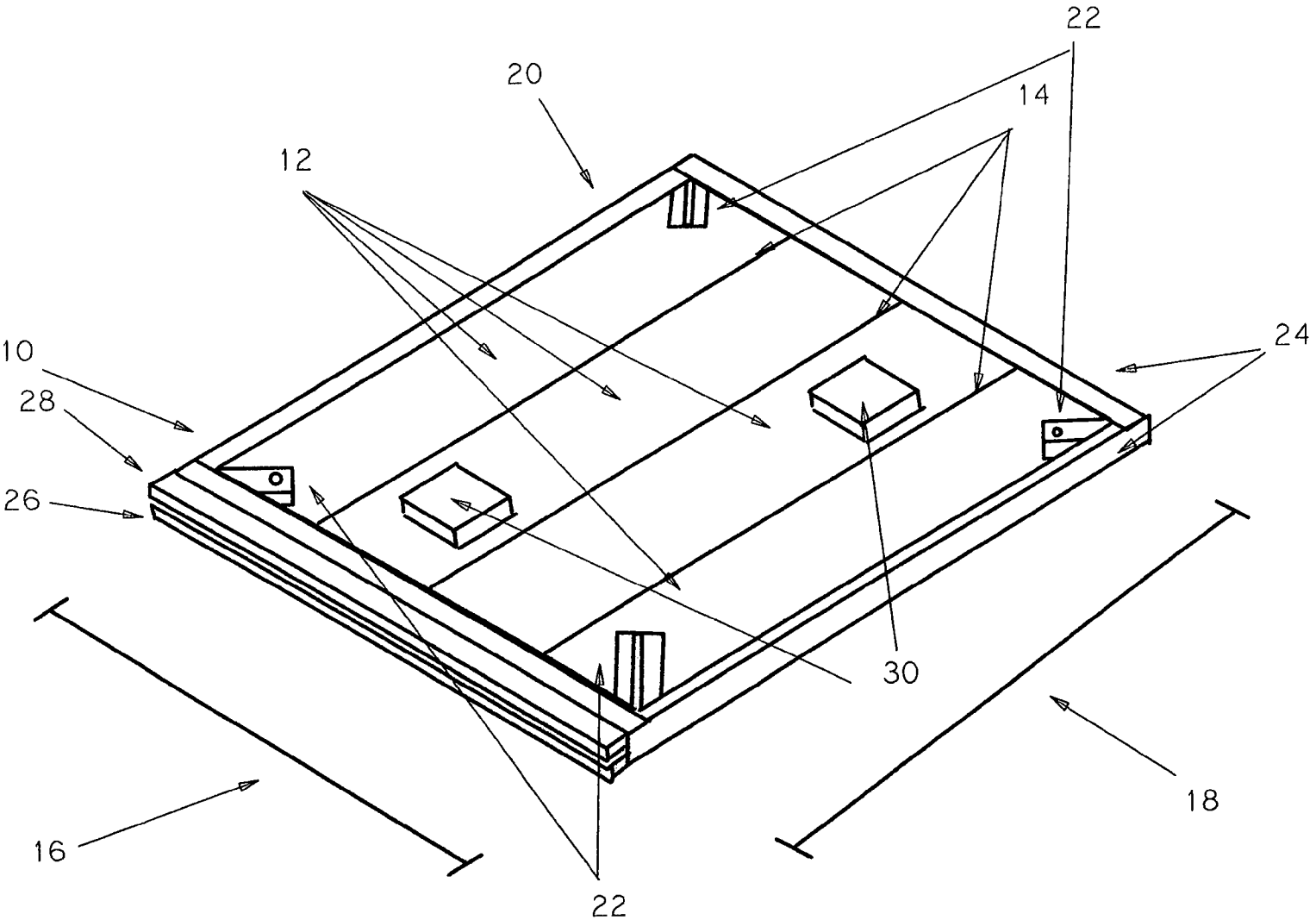
FIG. 1 is an oblique top view of a full contact floating roof subsection.

Referring to FIG. 1, a subsection 10 of a full contact floating roof of the present invention is shown. The subsection 10 is comprised of four square angle parallelepiped buoyant cells 12, which are joined together by joins 14. Thus, the width 16 of the subsection 10 will be essentially four times the width of each buoyant cell 12, and the length 18 will be essentially the length to which the buoyant cells have been cut. Because it may be convenient to pre-assemble subsections 10 away from the final construction site, the length 18 of the buoyant cells 12 can be determined by factors such as total weight of the subsection 10, shipping size limitations, or the dimensions of the overall roof to be constructed.

In the preferred embodiment, the subsection 10 is provided with a frame 20 which around the perimeter of the subsection 10, allowing for increased structural integrity for the subsection 10, and allowing for easy attachment of lift points 22 to the subsection 10. If one or more of the sides 24 of the subsection 10 will be in contact with the sides of the fluid containment tank (not shown) in which the floating roof will be installed, a primary 26 and secondary 28 seals are preferably attached to those sides 24. To facilitate removal of excess loads, such as rainwater, drains 30 may be inserted through one or more of the buoyant cells 12, and sealed in place with adhesives to prevent leakage around their perimeter.

Figure 2:
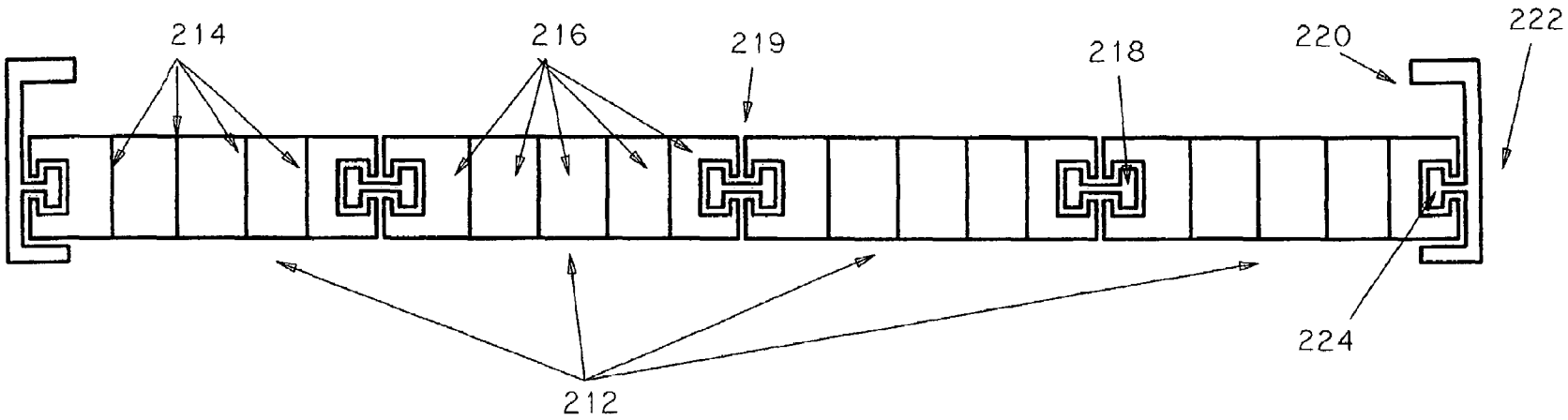
FIG. 2 is an end view of four extruded buoyant cells assembled as in FIG. 1.

Referring to FIG. 2, an end view of four buoyant cells 212, assembled as in FIG. 1, is shown. Each buoyant cell 212 comprises risers 214 which extend the length of the buoyant. cell 212, forming essentially independent sub-cells 216. In the preferred embodiment, formed strips of rigid or semi-rigid material 218 fit into extruded, gripping slots (see FIG. 3) in the sides of the buoyant cells 212, positioning the buoyant cells 212 in a tightly held relationship to each other. Adhesive (not shown) is additionally used in each of the joins 219, to further strengthen and seal the bonds between the buoyant cells 212. The sides 222 of the subassembly 210 comprise a frame 220, which is preferably formed of fiberglass or FRP with an extension 224 which fits into the extruded, gripping slots (see FIG. 3), and is preferably bonded further to the respective buoyant cell 212 with two-part urethane, preferably Pliogrip.

Figure 3:
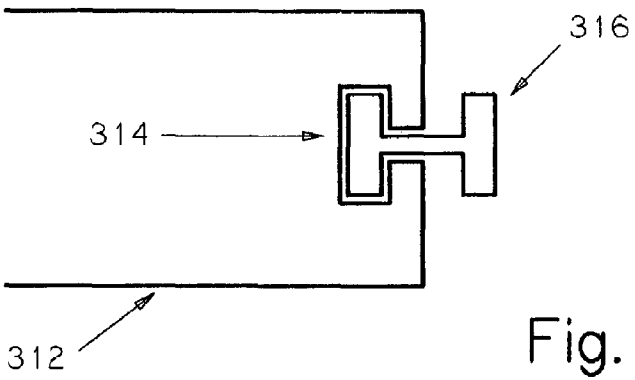
FIG. 3 is an end view of an extruded, gripping slot of the preferred embodiment.

Referring to FIG. 3, an end view of the extruded, gripping slot in the side of a buoyant cell 312 of the preferred embodiment is shown. The slot 314 is formed by extrusion so that a formed rigid or semi-rigid strip 316 can be securely slid into the slot 314, so that adjacent buoyant cells may be securely joined together. As those of skill in the art will recognize, other means of attachment of the buoyant cells is feasible, such as using bolts or screws, or using bridges secured to the top or bottom surface of the buoyant cells. Accordingly, this depiction of the preferred embodiment of the extruded, gripping slot 314 is for illustrative purposes only, and is not intended to limit the scope of the invention.

Figure 4:
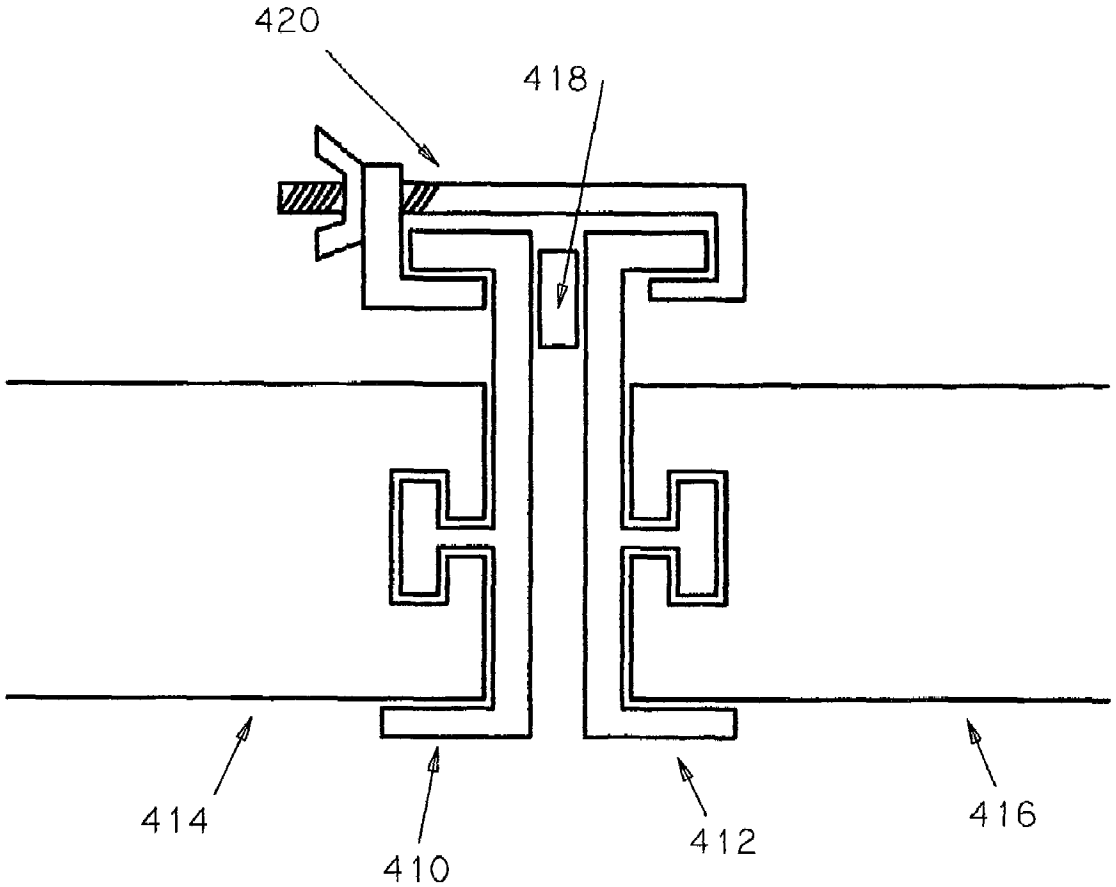
FIG. 4 is an end view of one embodiment of joining two subsections of FIG. 1.

Referring to FIG. 4, one method of joining two subsections such as that of FIG. 1 is shown. The frames 410, 412 of the respective subsections 414, 416 are positioned so that a gasket, preferably a self-stick gasket 418 can be placed between them to form a seal, and toggles 420 can be positioned at appropriate intervals down the length of the frames 410, 412 to securely tie subsections 414, 416 together. Thus, any number of subsections 414, 416 can be assembled side-to-side or end to end, as necessary to form the needed area for the full contact floating roof.

Figure 5A:
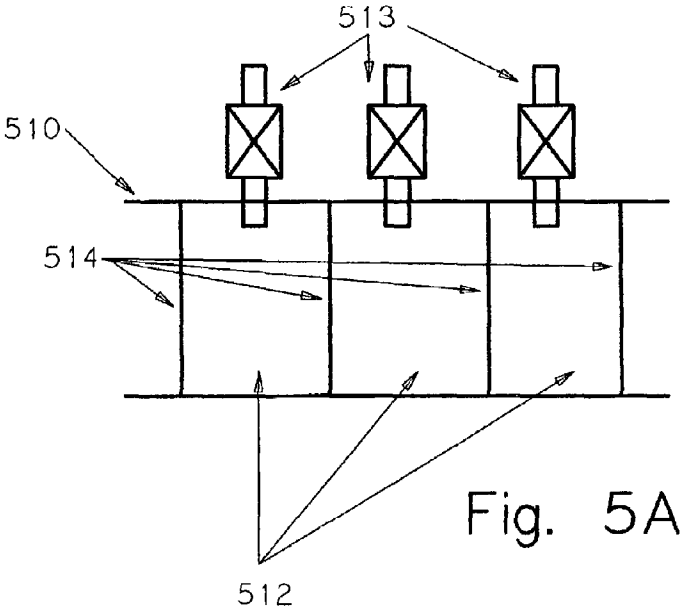
FIG. 5A is an end view of one embodiment of a buoyant cell.
Figure 5B:
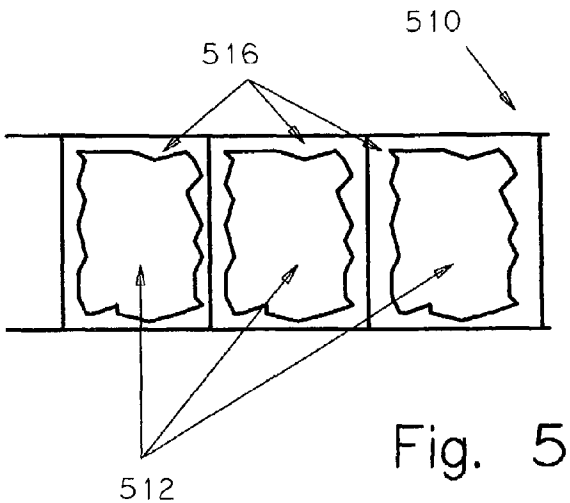
FIG. 5B is an end view of one embodiment of a buoyant cell.
Figure 5C:
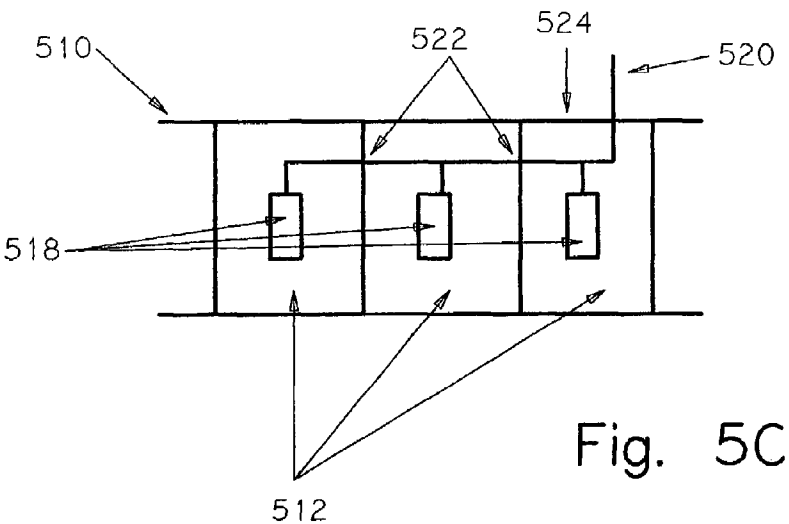
FIG. 5C is an end view of one embodiment of a buoyant cell.

Referring to FIGS. 5A, 5B, and 5C, various configurations of the interior of the buoyant cell 510 are shown. The sub-cells 512 may be filled with a gas through valves (or, alternatively, couplings) 513, such as an inert gas (not shown) to increase the fire-resistant qualities of the buoyant cell 510. Similarly, the interior walls 514 of the sub-cells 512 may be coated with an intumescent material 516 to provide fire-proofing, or, in the case of a puncture of the buoyant cell 510, fire-suppression. This coating can be easily accomplished by inserting a hose (not shown) with a spray attachment (not shown) down the length of the sub-cell 512, then spraying the intumescent material 516 while withdrawing the hose.

Further, fluid or gas probes 518 may be inserted in each sub-cell 512 for leak detection purposes, and may be placed in signal communication with a detector (not shown) by providing a signal lead 520 through a hole 522 (or slot, if at the end of the buoyant cell) in the walls 514 of the sub-cells 512. Sealant or adhesive (not shown) may be placed around the signal lead 520 where it penetrates the walls 514 to insure the continued separation of the sub-cells 512. The signal lead 520 can then be extended through the top 524 of the buoyant cell 510. As those of skill in the art will recognize, signal leads could be extended from each sub-cell 512 rather than being joined in a single feed, without departing from the spirit of the invention. However, using a single feed reduces the number of penetrating holes in the top 524.

Figure 6B:
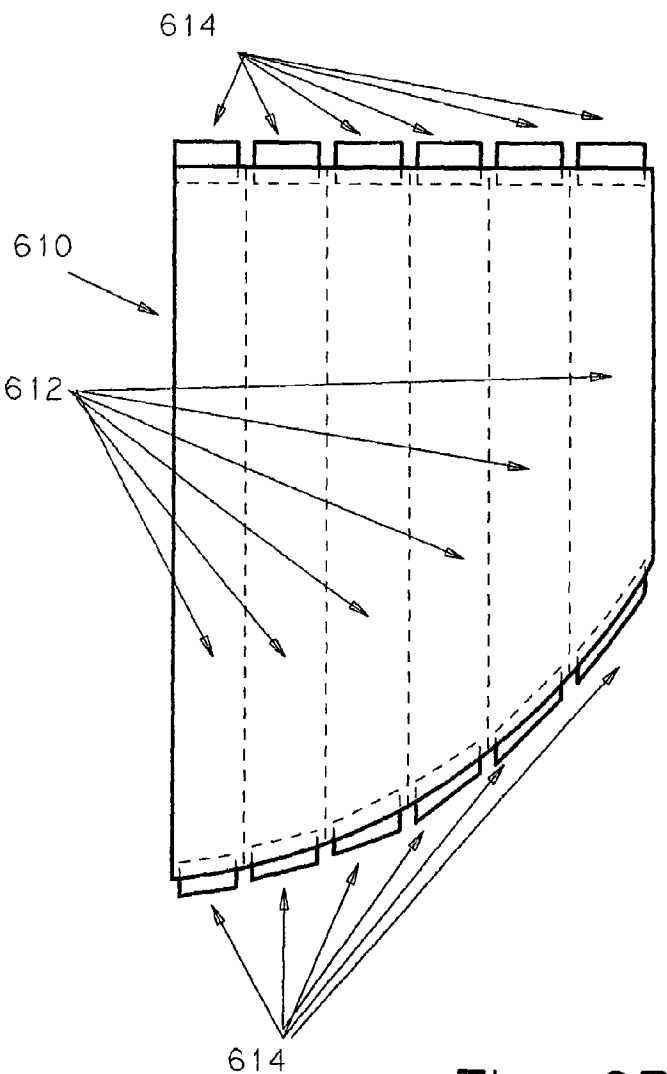
FIG. 6B is an overhead view of the end seals for a circular-roof buoyant cell.
Figure 6A:
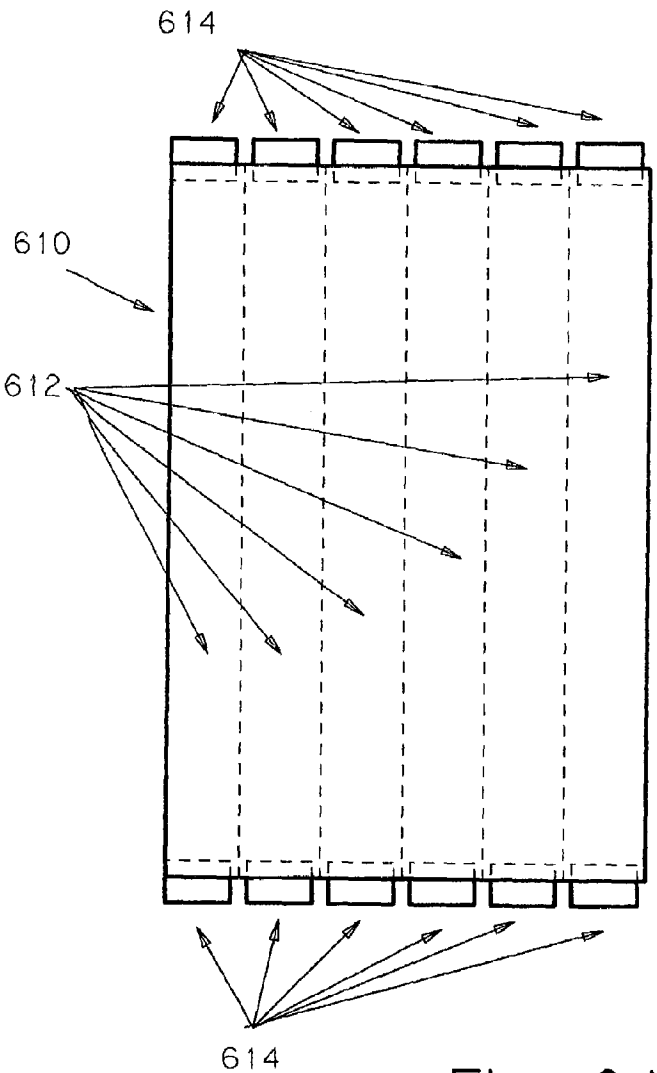
FIG. 6A is an overhead view of the end seals for a rectangular buoyant cell.

Referring to FIGS. 6A and 6B, multiple configurations of the seals for the ends of the buoyant cells 610 are shown. Each sub-cell 612 is sealed with a block 614 of material such as Valox, which is permanently set in place with adhesive. If the shape of the roof is round or oval rather than square, or even an irregular shape, the ends of the buoyant cells 610 may be cut to shape as needed, as shown in the example of a circular floating roof section of FIG. 6B. The sealing blocks 614 can then be cut to the shape of the end of each sub-cell 616, as needed. However, if the ends of adjacent sub-cells are sufficiently straight, a single block 614 of material may be used to bridge and seal the ends of more than one adjacent sub-cell (not shown).

Those of skill in the art will recognize that variations of the above description may be made without departing from the scope and spirit of this invention, and this invention shall not be unduly limited to these illustrative embodiments.

We claim:

1. A method of making a full contact floating roof having a top, a bottom, and a perimeter, comprising forming a linkage between a plurality of selectively interlinkable fiber reinforced plastic buoyant cells, each cell comprising an open interior volume and an exterior. and wherein said linkage is essentially impermeable to hydrocarbon fluids and vapors, and placing an intumescent material within said interior volume of at least one buoyant cell.

* * * * *